United States Patent [19]

Toyama et al.

[11] Patent Number: 4,475,520

[45] Date of Patent: Oct. 9, 1984

[54] CONTACTLESS ERRONEOUS IGNITION PREVENTION TYPE IGNITION SYSTEM FOR INTERNAL COMBUSTION ENGINE

[75] Inventors: Koichi Toyama, Kariya; Tomoatsu Makino, Okazaki, both of Japan

[73] Assignee: Nippondenso Co., Ltd., Kariya, Japan

[21] Appl. No.: 402,799

[22] Filed: Jul. 27, 1982

[30] Foreign Application Priority Data

Jul. 29, 1981 [JP] Japan ..... 56-119002

[51] Int. Cl.[3] ..... F02P 3/04

[52] U.S. Cl. ..... 123/618; 123/645

[58] Field of Search ..... 123/414, 418, 609, 618, 123/645, 646

[56] References Cited

U.S. PATENT DOCUMENTS 3,943,896 3/1976 Green et al. ..... 123/618 X 3,991,730 11/1976 Crall ..... 123/618

3,991,733 11/1976 Harris ..... 123/618

*Primary Examiner*—Tony M. Argenbright

*Attorney, Agent, or Firm*—Cushman, Darby & Cushman

[57] ABSTRACT

A contactless erroneous ignition prevention type ignition system for internal combustion engines, in which the energization of the ignition coil is held regardless of an input signal for a predetermined time period after starting the energization. At a first predetermined time after the output signal of a rotational signal generator corresponding to the rotational speed of the internal combustion engine exceeds a reference level, the energization of the ignition coil is started, and the energization of the ignition coil is maintained regardless of the output signal of the rotational signal generator until a second predetermined time. The charging timing of a capacitor of a frequency-voltage converter circuit for controlling the dwell angle of the ignition coil is controlled according to the first and second predetermined times.

3 Claims, 6 Drawing Figures

CONTACTLESS ERRONEOUS IGNITION PREVENTION TYPE IGNITION SYSTEM FOR INTERNAL COMBUSTION ENGINE

The present invention relates to an improvement of a contactless ignition system used with internal-combustion engines, especially for automobiles, or more in particular to a contactless ignition system comprising a circuit for preventing erroneous ignition operations which otherwise might be caused by an induction noise produced by the intermittent current of the ignition coil or an ignition spark.

Generally, a contactless ignition system comprises an ignition coil, a signal generator including a pickup coil of magnet induction type, and an ignition amplifier driven by an output signal of the signal generator for generating a high voltage across the ignition coil at an appropriate ignition timing. The ignition voltage generated across the ignition coil reaches as high as 10 to 30 KV, and therefore in the prior art systems, the induction noise is undesirably picked up by the signal generator thus presenting a number of problems of erroneous operation. Further, in the case where the signal generator is located near to the ignition coil or a wire through which the primary ignition coil current flows, the leakage magnetic fluxes generated thereby cause induction noise to be superimposed on the signal generator, thereby leading to a similar problem of erroneous operation.

The present invention is intended to obviate the above-mentioned problems of the prior art systems and an object thereof is to provide an ignition system in which the ignition coil begins to be energized at a first predetermined time after the output signal of an engine rotational speed signal generator exceeds a reference level, and the energization of the ignition coil is maintained regardless of variations of the output signal of the rotational signal generator till a second predetermined time after the first predetermined time, thereby preventing erroneous operations which otherwise might occur with the beginning of energization of the ignition coil.

According to a preferred aspect of the present invention, there is provided an ignition system comprising a signal generator, an input detector circuit for detecting an output of the signal generator at a predetermined trigger level, a first duration detector circuit for detecting a first duration of a level of the input detector circuit, and a second duration detector circuit for detecting a second duration of the same level, in which the ignition coil begins to be energized by the output of the first duration detector circuit, and the energization of the ignition coil is maintained regardless of the output of the input detector circuit until generation of an output of the second duration detector circuit, thus preventing an erroneous operation which otherwise might be caused by various induction noises. Also, for detecting the first and second durations, the charge and discharge waveforms of a capacitor are detected at two detection levels, thereby making up a very efficient circuit configuration. This capacitor doublly operates as a timing capacitor for determining a charging timing of a charging capacitor of a frequency—voltage (f−V) converter circuit for controlling the dwell angle together with the engine speed, thus preventing erroneous ignition operations by a very simple construction.

Further objects, features and advantages of the present invention will be clearly understood from the detailed description taken in conjunction with the accompanying drawings, in which.

Figure 1:
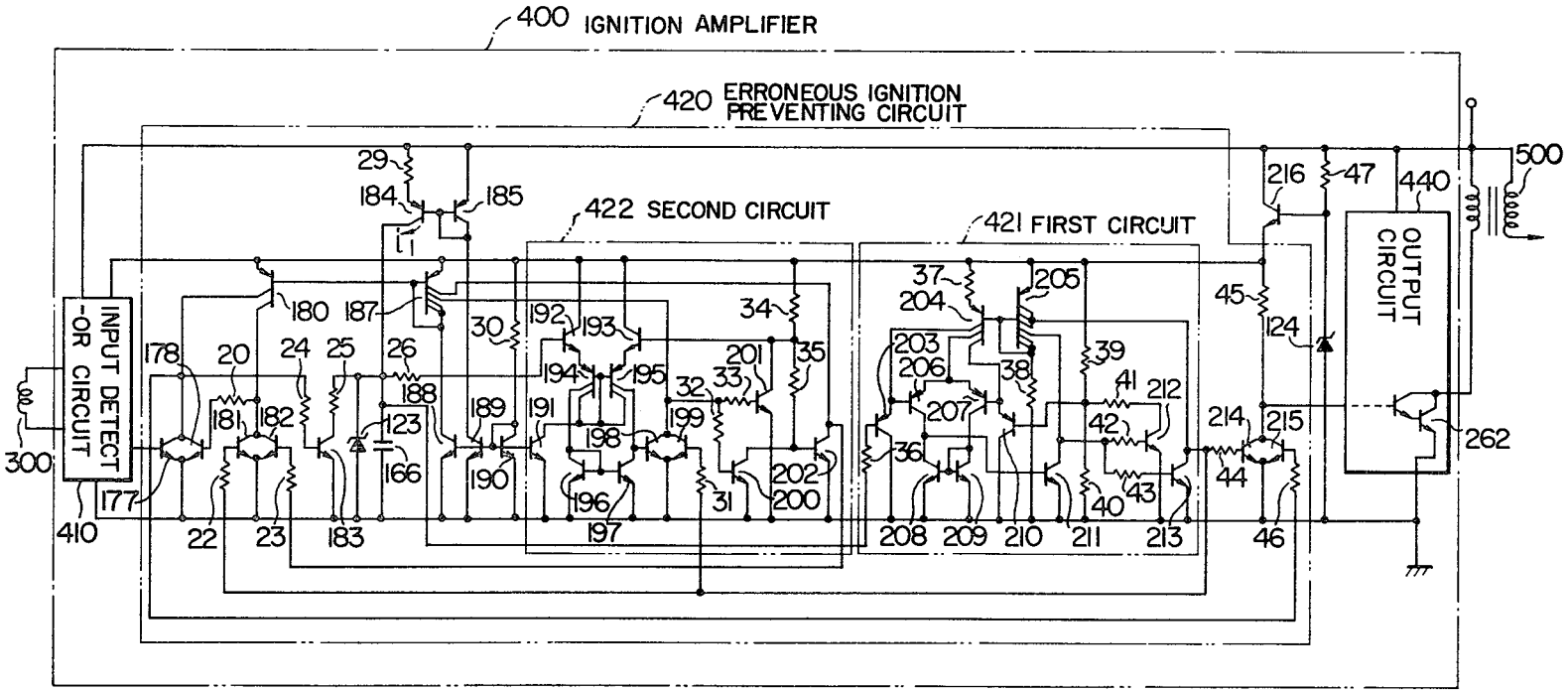
FIG. 1 is a diagram showing an electrical circuit of a first embodiment of the present invention.

A first embodiment of the present invention will be explained with reference to FIG. 1. In FIG. 1, reference numeral 300 designates a signal generator (dynamo) rotated in synchronism with the engine, and numeral 400 an ignition amplifier including an input detector circuit 410 having a waveform shaping circuit for converting the AC output of the signal generator 300 into a rectangular wave, an erroneous ignition preventing circuit (hereinbelow simply called error preventing circuit) 420, and an output circuit 440 for interrupting the ignition coil 500. The error preventing circuit 420 includes a first circuit 421 for detecting the first duration (between $t_1$ and $t_2$ in FIGS. 2A and 2B) utilizing the charged voltage waveform of the capacitor 166 making up a time function generator circuit, a second circuit 422 for detecting the second duration (between $t_1$ and $t_3$ in FIGS. 2A and 2B) and other switch circuits. The error preventing circuit 420 includes resistors 20, 22 to 26, 29 to 47, zener diodes 123, 124, a capacitor 166, and transistors 177, 178, 180 to 185, 187 to 215.

The operation of the system having the above-mentioned configuration will be described with reference to the timing charts of FIGS. 2A and 2B. FIG. 2A shows the case in which an induction noise is not superimposed on the output of the signal generator 300, while FIG. 2B shows a waveform assumed to be formed in the case where an induction noise produced at the time of energization of the ignition coil 500 and an induction noise caused by the ignition voltage generated across the ignition coil are superimposed on the output of the signal generator 300.

Figure 2B:
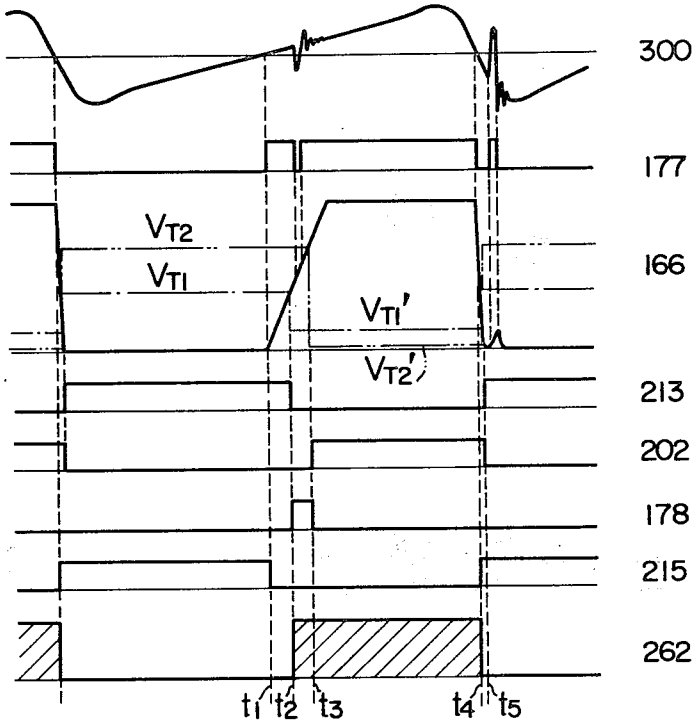
FIGS. 2A and 2B are timing charts showing the operation thereof.
Figure 2A:
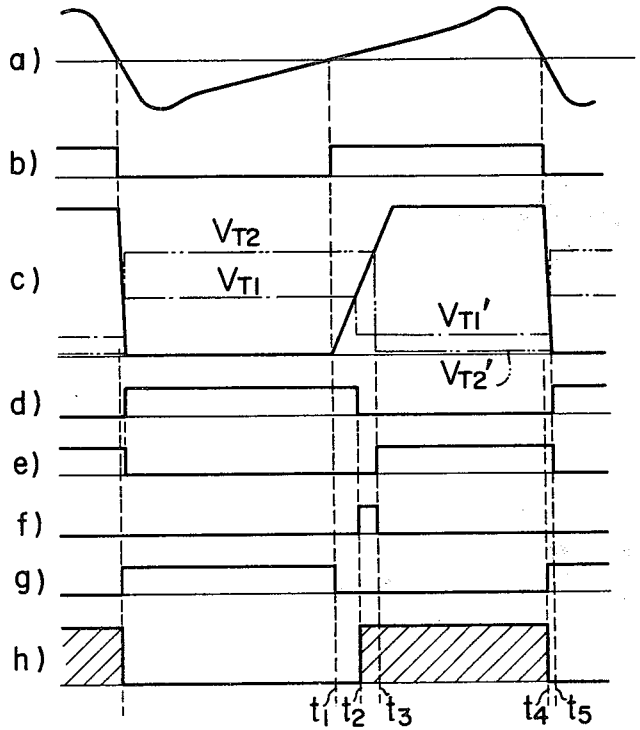

In FIGS. 2A and 2B, numeral (a) shows an AC output waveform of the signal generator 300. A predetermined level of this AC output waveform is detected and produced by the input detector circuit 410. This output is such that when the AC output is positive in polarity, the transistor 177 of the error preventing circuit 420 is turned on. This output, namely, the base waveform of the transistor 177 is shown in (b) of FIGS. 2A and 2B. When the transistor 177 is turned on at the time point $t_1$ in FIG. 2A, the collector potential of the transistor 177 is reduced from "1" to "0" level since the transistor 178 is off as mentioned later. The transistor 183 is turned off. Thus, the collector current of the transistor 184, that is, the collector current $i_1$ produced by the current mirror circuit including the transistors 189 and 190 and the current mirror circuit including the transistors 184 and 185 that has thus far been absorbed by the transistor 183 ceases to be absorbed thereby, so that the current $i_1$ begins to charge the capacitor 166. The first circuit 421 and the second circuit 422 each include a differential amplifier for detecting and producing the charge voltage of the capacitor 166 independently of each other at different detection levels. The generation timing of the detection output of the first detector 421 (hereinafter referred to as the "ignition first control signal" or "first output") is set earlier than the generation timing of the detection output of the second circuit 422 (hereinafter referred to as the "ignition second control signal" or "second output").

When the charged voltage of the capacitor 166 reaches the level $V_{T1}$ shown in FIGS. 2A and 2B, the transistor 211 of the first circuit 421 is turned off at the time point $t_2$, while the transistor 212 is turned on. Since the resistors 40 and 41 are connected in parallel to provide a hysteresis such that the level $V_{T1}$ determined by the division ratio of the resistors 39 and 40 is changed to the level $V_{T1}'$ shown in FIGS. 2A and 2B, while the transistor 213 is turned off thereby to produce a first output. The waveform of the collector potential of the transistor 213, namely, the base potential of the transistors 214 and 181 is shown in (d) of FIGS. 2A and 2B. The first output is applied through the resistor 22 to the transistor 181 thereby to turn off the transistor 181 that has thus far been on.

When the charged voltage of the capacitor 166 further increases and reaches the level $V_{T2}$ shown in FIGS. 2A and 2B, an output is produced from the second circuit 422 at time point $t_3$, so that the transistor 193 is turned off while the transistors 200 and 201 are turned on. The detection level $V_{T2}$ of the second circuit 422 is determined by the division voltage attributable to the base-emitter saturation voltage of the transistor 202 and the resistors 34 and 35, while the level $V_{T2}'$ is reduced substantially to zero level by the hysteresis provided by the turning on of the transistor 201. In response to the turning on of the transistor 200, the transistor 202 is turned off thereby to produce a second output. The collector waveform of the transistor 202, that is, the base waveform of the transistor 182 is shown in (e) of FIGS. 2A and 2B.

The first and second outputs are applied to the bases of the transistors 181 and 182 respectively, so that the collector waveform of the transistor 181 and 182 are maintained at "1" level only during the period from time point $t_2$ to time point $t_3$. The collector waveform of the transistors 181 and 182, namely the base waveform of the transistor 178 is shown in (f) of FIGS. 2A and 2B. The collector output of the transistors 177 and 178 is applied to the base of the transistor 215. The base waveform of the transistor 215 is shown in (g) of FIGS. 2A and 2B. The collector output of the transistors 214 and 215 is amplified and applied to the power transistor 262 of the output circuit 440, with the result that the power transistor 262 is turned on and energization of the ignition coil 500 is started when both the transistors 214 and 215 are turned off. This process will be explained with reference to the timing charts of FIGS. 2A and 2B. At the time point $t_2$ when the first output is produced, the transistor 214 is turned off (the transistor 215 being already turned off at time point $t_1$), thus starting the energization of the ignition coil 500. This condition continues until the output of the input detector circuit 410 is reversed at the time point when the AC output of the signal generator 300 suddenly changes from positive to negative, so that the transistor 177 is turned off at time point $t_4$. The transistor 215 is turned on, so that the power transistor 262 is turned off. Also, the transistor 177 is turned off so that the transistor 183 is turned on, and the charges of the capacitor 166 are discharged rapidly through the resistor 25. At the time point $t_5$ when the terminal voltage of the capacitor 166 reaches $V_{T1}'$, the first output is reversed and the output thereof turns on the transistor 199, while the transistors 200 and 201 are turned off. The reference level of the second circuit 422 is restored from $V_{T2}'$ to $V_{T2}$ while at the same time reversing the second output.

Explanation is made above about the case in which the induction noise is not superimposed on the AC output of the signal generator. Now, the case in which such an induction noise is superimposed on the AC output of the signal generator will be explained. As the induction noise, take the noise caused by starting the energization of the ignition coil and by the ignition voltage, for example.

In FIG. 2B, assume that a noise as shown in (a) of FIG. 2B is superimposed on the AC output of the signal generator 300 immediately after starting the energization of the ignition coil at time point $t_2$. The input detector circuit 410 naturally operates in response, and the base waveform of the transistor 177 drops temporarily as shown in (b) of FIG. 2B, and the transistor 177 is turned off. Since the transistor 178 is turned on at the time point $t_2$ (this condition continues until time point $t_3$ when the second output is produced), however, the transistor 183 is not affected by remains off nor is the charging operation of the capacitor 166 affected. Since the transistor 178 is turned on, the collector potential of the transistors 177 and 178 is maintained at "0", so that the transistor 215 is kept off. The power transistor 262 is thus kept on and does not respond to the erroneous operation of the input detector circuit 410.

Now, assume that the energization of the ignition coil 500 is cut off at time point $t_4$ in FIG. 2B and a noise as shown in (a) of FIG. 2B is superimposed on the AC output of the signal generator 300 just after time point $t_5$. The input detector circuit 410 naturally responds and the transistor 177 is turned on temporarily, while the transistor 183 is turned off, thus starting the charging of the capacitor 166. However, the induction noise disappears before the charge voltage of the capacitor 166 reaches the level $V_{T1}$ where the first output is generated. At the same time, the erroneous operation signal of the input detector circuit 410 also disappears, thereby preventing an erroneous operation since the power transistor 262 fails to be turned on.

An application to a general contactless ignition system having a fixed energization angle of the ignition coil 500 is explained above with reference to the first embodiment. The present invention is not of course limited to such an embodiment but may be applied with equal effect to a contactless ignition system of dwell angle control type for controlling the energization angle of the ignition coil 500.

Figure 3A:
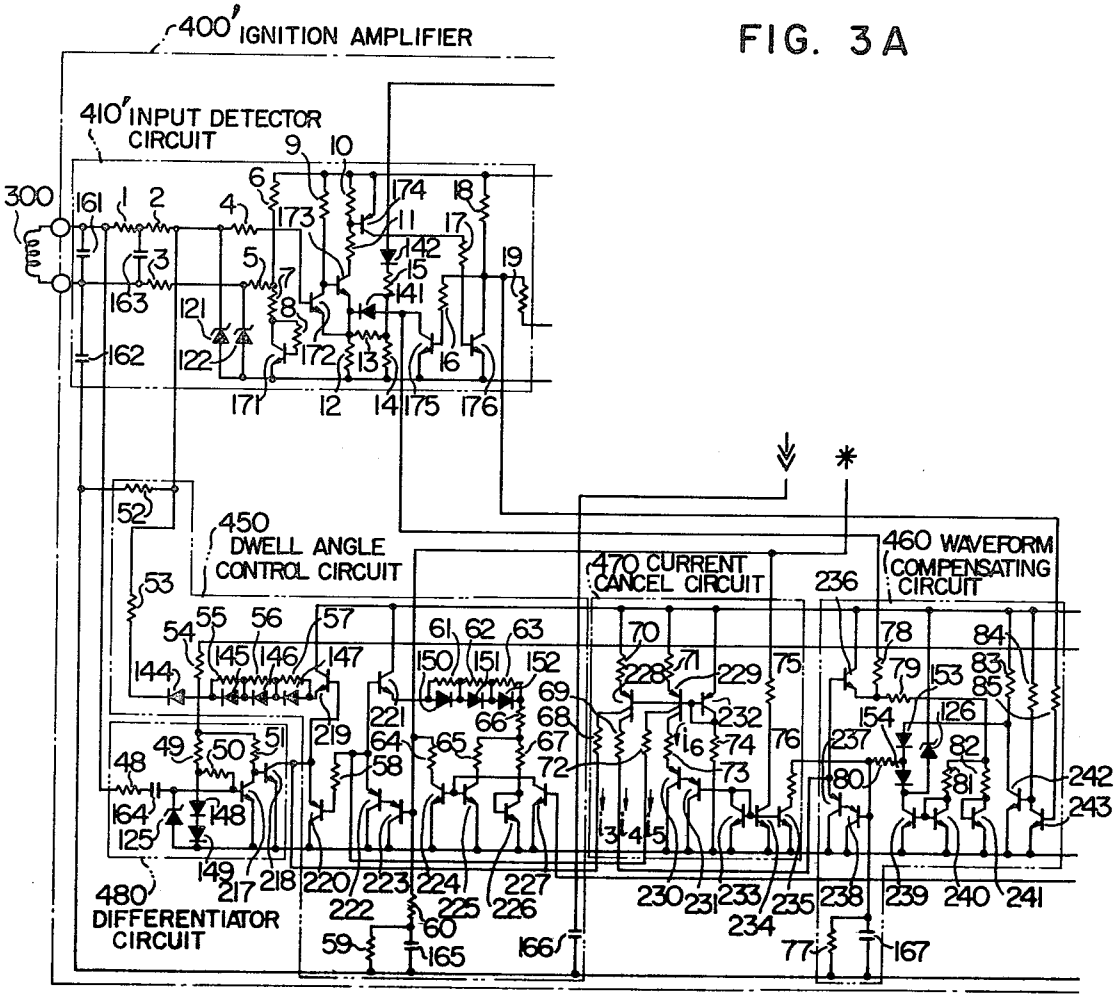
FIGS. 3A and 3B are a diagram showing an electrical circuit of a second embodiment of the present invention.
Figure 3B:
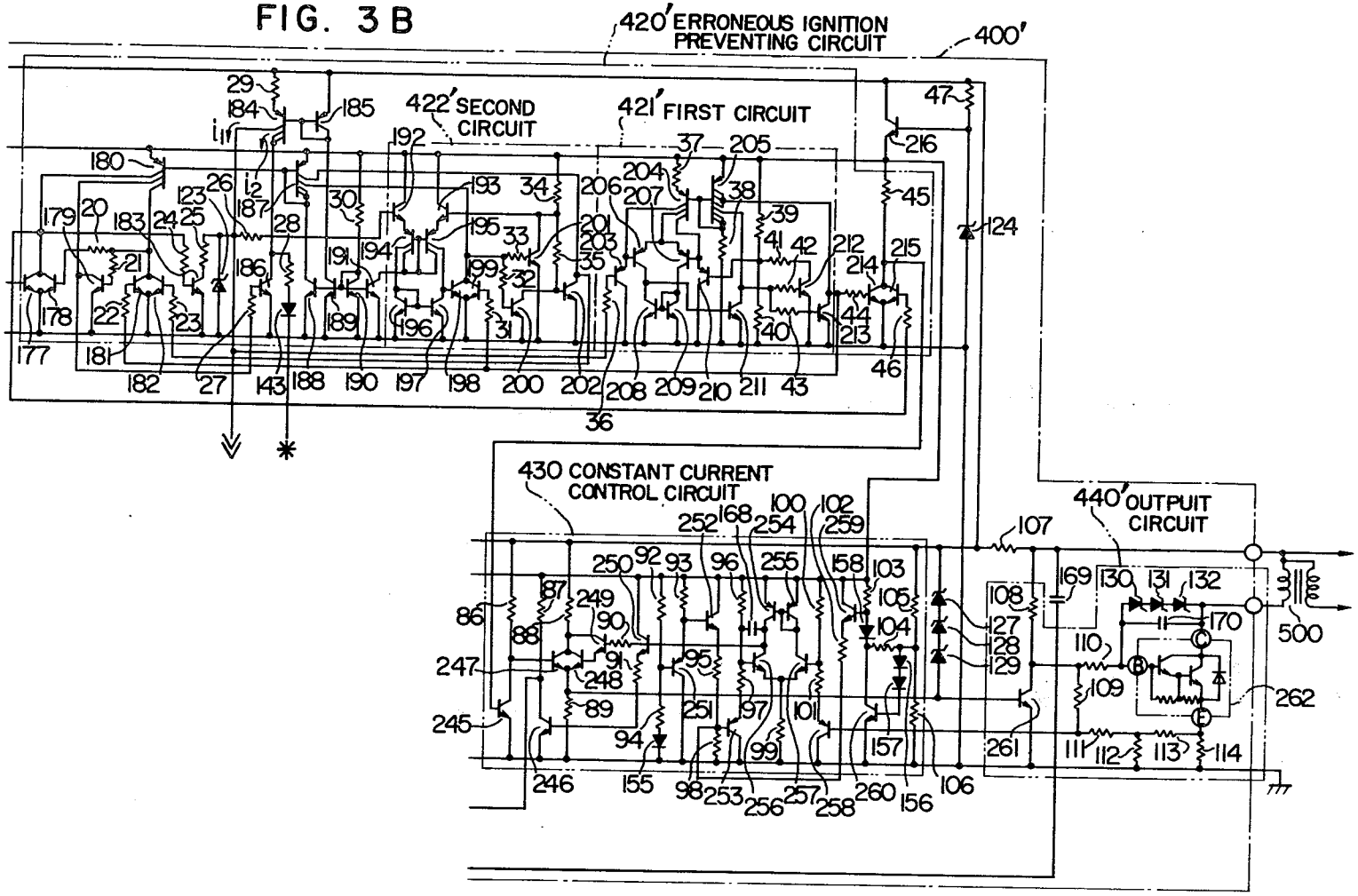

A second embodiment of the present invention relating to such a contactless ignition system of dwell angle control type will be explained with reference to FIG. 3. In FIG. 3, the component elements denoted by the same reference numerals as in FIG. 1 showing the first embodiment designate the same or equivalent elements thereto.

Numeral 300 designates an AC generator, and numeral 400' an ignition amplifier including an input detector circuit 410' for converting the output of the AC generator 300 into a rectangular waveform, an error preventing circuit 420' including a first circuit 421' and second circuit 422' which are identical with the circuits 400, 410, 420, 421 and 422 explained with reference to the first embodiment, a constant current control circuit 430 for detecting the current at the primary side of the ignition coil 500 and controlling the current not to exceed a predetermined value, an output circuit 440' turned on and off by the control output of the error preventing circuit 420' a dwell angle control circuit 450 for applying a bias voltage to the input detector circuit 410' thereby to control the dwell angle optimally in response to the engine speed, a waveform compensating circuit 460 for increasing the trigger level of the input detector circuit 410' after the turning off of the power transistor 262 and reducing the trigger level with time thereby to strengthen the noise on the one hand and controlling the dwell angle to an optimum level on the other hand, a current cancel circuit 470 for cancelling the minor current flowing from the voltage detector circuit for detecting the voltage across the capacitor 165 of the dwell angle control circuit 450 and the capacitor 167 of the waveform compensating circuit 460 into these capacitors and eliminating the control error, and a differentiator circuit 480 for detecting a sharp rise period of the AC output of the AC generator 300 for eliminating the variations of the ignition timing caused by application of the bias voltage to the input detector circuit 410' and preventing the bias voltage from being applied from the dwell angle control circuit 450 to the input detector circuit 410' during that period. These circuits include resistors 1 to 114, zener diodes 121 to 132, diodes 141 to 158, capacitors 161 to 170 and transistors 171 to 261.

Figure 4:
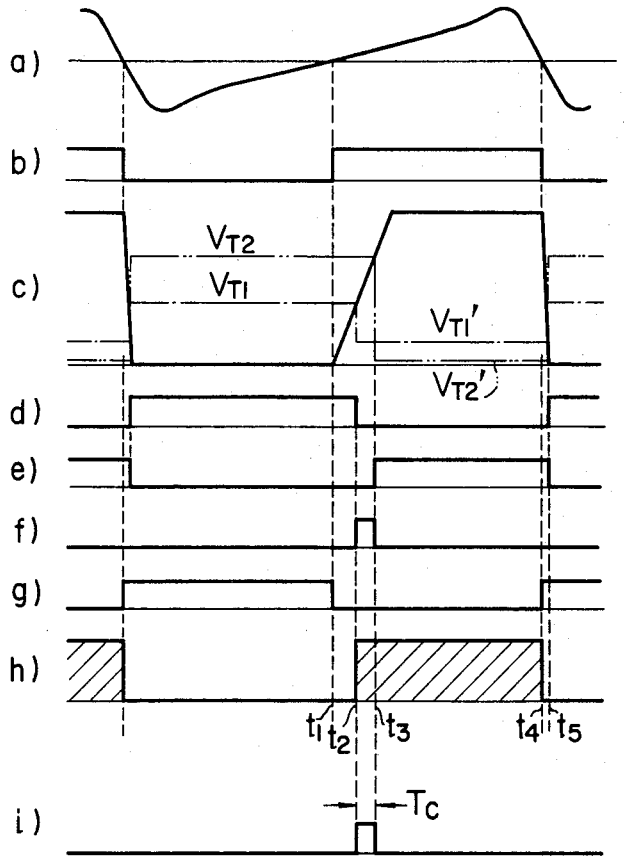
FIG. 4 is a timing chart showing the operation thereof.

In the system having the above-mentioned construction, explanation will be first made about the basic operation of the input detector circuit 410', the error preventing circuit 420' and the output circuit 440' with reference to the timing chart of FIG. 4 before the constant current control circuit 430, the dwell angle control circuit 450, the waveform compensating circuit 460, the current cancel circuit 470 and the differentiator circuit 480. In FIG. 4, the waveforms (a) to (h) which are shown by the same reference characters as the waveforms described with reference to FIG. 2 will not be explained again. Also, the explanation of the error preventing circuit 420', the operation of which is substantially the same as that of the error preventing circuit 420 of FIG. 1, will be partially omitted as the error preventing circuit 420' is different from the error preventing circuit 420 only in that in the error preventing circuit 420' transistors 179 and 186 are added, the number of the collectors of the transistors 180 and 184 is increased, resistors 21, 27 and 28 and a diode 143 are added, and the capacitor 166 is changed to the construction of the dwell angle control circuit 450.

First, the signal generator 300 turns on the transistor 172 through the input detector circuit 410', a filter circuit including the resistor 1 and the capacitors 161 and 163. When the transistor 172 is turned on at the positive polarity of this AC output, the transistors 173, 174 and 176 are turned off, while the transistor 177 is turned on. The transistor 183 is turned off thereby to start charging the capacitor 166. At the time point when the charged voltage thereof reaches the level $V_{T1}$, a first output is produced and when the charged voltage reaches the level $V_{T2}$, a second output is produced. Only during the period from the time point $t_2$ when the first output is produced and the time point $T_3$ when the third output is produced, the collector potential of the transistors 181 and 182 is raised to "1" level so that the transistor 179 is turned on while the transistor 186 is turned off. As a result, the collector current $i_2$ flows from the collector of the transistor 184 of a current mirror circuit made up of the transistors 184 and 185, through the resistor 28, the diode 143 and the resistor 60 to the capacitor 165 thereby to charge the same. The collector output waveform of the transistor 186 under this condition is shown by (i) of FIG. 4. The amount of electric charge charged up on the capacitor 165 by each charging operation is determined by the time between $t_2$ and $t_3$ (the period Tc in FIG. 4) during which the capacitor 166 is charged by the collector current $i_1$ of the transistor 184. When this charging operation is repeated to the capacitor 166, the capacitor 165 is charged in proportion to the number of times equal to the repetitions, thus forming a frequency-voltage converter circuit. The functions of the capacitors 165 and 166 will be explained in detail. In the case where the whole circuits are constructed of integrated circuits by forming the transistors and resistors into a single chip as a monolithic IC, variations of the constant of the resistors occur commonly between production lots of the monolithic ICs. The charging current $i_2$ for the capacitor 165 thus appears to be varied among the production lots of the monolithic ICs, resulting in different amounts of charge thereof. Nevertheless, since the charging period of the capacitor 165 is determined by the amount of electric charge of the capacitor 166 and the charging current for the capacitor 166 is determined by the collector current $i_1$ of the transistor 184, however, the ratio of $i_1$ to $i_2$ remains the same although the charging current $i_1$ or $i_2$ is different for different production lots. The charging period of the capacitor 165 varies with the production lot according to the charging current $i_1$ or $i_2$, with the result that the charged voltage of the capacitor 165 with respect to the repetition number of charging operations makes up a stably and uniformly variable conversion voltage with respect to frequency and with the result of providing a stable frequency-voltage converter circuit without variations between production lots. The capacitor 166 for determining the charging timing of the capacitor 165 of the frequency-voltage converter circuit also functions as a capacitor required for detecting the first and second durations.

The control output of the error preventing circuit 420' is such that when the first output is produced, the collectors of the transistors 214 and 215 are raised to "1" level, so that the transistor 245 is turned on, the transistor 247 is turned off and the transistor 261 is turned off, with the result that the power transistor 262 is turned on, thus starting energization of the ignition coil 500. At the time point when the AC output of the signal generator 300 changes sharply from positive to negative polarity, the transistor 177 is turned off, the transistor 215 is turned on, the transistor 245 is turned off, the transistors 247 and 261 are turned on, the power transistor 262 is turned off, thus cutting off the primary current of the ignition coil 500.

The constant current control circuit 430 will be explained. When the control output of the error preventing circuit 420' is raised to "1" level, the transistor 245 is turned on, the transistor 247 is turned off, and the transistor 261 is turned off, so that the power transistor 262 is turned on, thus applying current to the primary winding of the ignition coil 500. This primary current is detected as a voltage drop across the resistor 114, and the voltage divided by the resistors 112 and 113 is detected by a differential amplifier including the transistors 253, 254, 255, 256, 257 and 258. The base of the transistor 253 of the differential amplifier circuit is impressed with a reference voltage determined by a series circuit of the resistors 92, 94 and the diode 155 through the transistors 251, 252 and the resistor 95. The operation of the transistors 259 and 260 will be explained. In the case where the source voltage is low, the constant voltage circuit including the zener diode 124, the resistor 47 and the transistor 216 fails to produce a constant voltage output, so that the reference voltage determined by the resistors 92, 94 and the diode 155 is also reduced. The transistors 259 and 260 make up a reference voltage compensating circuit for compensating such a situation when a low voltage is involved. When the voltage divided by the resistors 105 and 106 is reduced below the sum of the forward voltage drop across the diodes 156 and 157 and the base-emitter saturation voltage of the transistor 260, the transistor 260 is turned off with the result that the transistor 259 is turned on, so that a compensating bias is applied to the base of the transistor 253 through the resistor 102. When the primary current exceeds a predetermined value, the transistor 256 is turned off and the transistor 248 is turned on following the transistor 249. The transistor 261 thus conducts, so that the base current flowing in the power transistor 262 is absorbed through the resistors 108 and 110, thus controlling the primary current in the power transistor 262 at a constant level.

The operation of the circuits including the dwell angle control circuit 450 will be explained. It has been explained that the capacitor 165 is charged with a voltage subjected to the frequency-voltage conversion, that is, a voltage corresponding to the engine speed. This voltage corresponding to the engine speed provides an emitter output of the transistor 219 via the transistors 223, 222, the resistor 58 and the transistor 220. This output is applied to a function generator circuit including the diodes 145, 146, 147 and the resistors 55, 56, 57 for producing a non-linear output the change of which is small at low speed and great at high speed. This non-linear output is applied as a bias to the base of the transistor 172 of the input detector circuit 410' through the diode 144 and the resistor 53. With the increase in the bias, the turn-on timing of the input transistor 172 is advanced, so that the turn-on timing of the power transistor 262 turned on and off in synchronism with the input transistor 172 is also advanced, thus enlarging the conduction time (dwell angle) of the ignition coil 500. The transistor 221 also produces a non-linear output proportional to the engine speed, the change of which is small at low speed and progressively great at high speed, due to the function generator including the diodes 150, 151, 152 and the resistors 61, 62, 63. During the period when the constant current control circuit 430 does not control the output circuit 440', the transistor 246 is turned off and the transistor 227 is turned on, so that the output of the transistor 221 flows through the transistors 226 and 227, thus keeping the charge voltage of the capacitor 165 or the bias unchanged. When the constant current control circuit 430 controls the power transistor 262 of the output circuit 440' to constant current, on the other hand, the transistor 246 is turned on and the transistor 227 is turned off, with the result that the output of the transistor 221 flows through the transistors 226 and 225. Since the transistors 224 and 225 make up a current mirror circuit, the transistor 224 is turned on thereby to slowly discharge the charges of the capacitor 165. As a result, the emitter potential of the transistors 223 and 222 slowly decreases. The base potential of the transistor 221 is accordingly reduced in non-linear manner and the emitter potential of the transistor 220 is also reduced slowly, while at the same time reducing the emitter potential of the transistor 219, thus reducing the bias applied to the base of the transistor 172 through the diodes 144 to 147 and the resistors 53 to 57. The trigger level of the input detector circuit 410' is determined to obtain an optimum dwell angle from the bias mentioned above and the output of the waveform compensating circuit 460 described later.

The operation of the waveform compensating circuit 460 will be described. A rectangular wave produced from the transistor 176 of the input detector circuit 410' and corresponding to the AC output of the AC generator 300 is applied to the waveform compensating circuit 460. When the power transistor 176 is turned off, the transistor 243 is on and the transistor 242 is off. When the transistor 242 is turned off, the capacitor 167 is charged through the resistor 83, the diode 153 and the resistor 80 thereby to raise the terminal voltage of the capacitor 167. This terminal voltage controls the base potential of the transistor 236 through the transistors 238 and 237, so that the output of the transistor 236 is proportional to the terminal voltage of the capacitor 167. When the transistor 176 is off, the transistor 175 is turned on, so that the output current of the transistor 236 flows through the resistor 78 and the transistor 175 thus maintaining the collector potential of the transistor 175 at "0". When the transistor 176 is turned on, on the other hand, the transistor 242 is also turned on, so that the capacitor 167 ceases to be charged and discharges through the resistor 77, the resistor 80, the diode 154 and the transistor 239 at a rate proportional to the terminal voltage of the capacitor 167 that is the emitter potential of the transistor 236. When as a result of the discharge the terminal voltage of the capacitor 167 is reduced below the difference Vcc–Vz between the collector source voltage Vcc of the transistor 236 and the zener voltage Vz of the zener diode 126, the diode 154 is biased in reverse direction and is turned off, with the result that the charges of the capacitor 167 are discharged only through the resistor 77. When the transistor 175 is turned off, therefore, the collector potential of the transistor 175 takes a level proportional to the terminal voltage of the capacitor 167. This potential controls the emitter potential of the transistors 172, 173 of the input detector circuit 410' and thus determines, in cooperation with the bias output obtained through the resistor 53 and the diode 144 of the dwell angle control circuit 450, the trigger level of the input detector circuit 410' in a manner to attain an optimum dwell angle.

The operation of the current cancel circuit 470 will be explained. The transistors 232, 229 and 228 produce constant currents of the same value. Substantially the whole of the current $i_4$ flows in the transistors 237 and 238 for detecting the voltage of the capacitor 167 of the waveform compensating circuit 460. (Part of the current $i_4$ flows as the base current of the transistor 236 and is negligible.) Substantially the whole of the current $i_5$ flows in the transistors 223 and 222 for detecting the voltage of the capacitor 165 of the dwell angle control circuit 450. The current $i_6$ flows in the transistors 230 and 231, and the base current of the transistor 231 is substantially equal to the base current of the transistors 238 and 223. The transistors 233, 234 and 235 make up a current mirror circuit, so that the base current flows in the transistor 233, and the same current as this is absorbed by the transistors 234 and 235 from the bases of the transistors 238 and 223 respectively. The base current of the transistors 223 and 238 for detecting the voltage of the capacitors 165 and 167 is absorbed and cancelled by the transistors 234 and 235 respectively, so that the amount of charge of the capacitors 165 and 167 is not affected with the result of causing no control error.

Now, the differentiator circuit 480 will be explained. Since the AC output of the AC generator 300 is differentiated by the capacitor 164, the transistor 217 is turned off and the transistor 218 is turned on during a predetermined time of a sharp fall of the AC output. The bias voltage corresponding to the engine speed produced through the capacitor 165 and the transistors 223, 222 and 220 is grounded by the transistor 218 for a predetermined time of the sharp fall of the AC output of the AC generator 300, that is, during the time when the transistor 218 is turned on, with the result that the bias applied to the base of the transistor 172 through the diode 144 and the resistor 53 disappears. During the period for determining the ignition timing, therefore, a bias fails to be applied to the base of the transistor 172 so that the trigger level of the input detector circuit 410' remains constant regardless of the bias. Even if the bias is changed by the change of the engine speed, therefore, the ignition timing is not affected at all.

Explanation is made above about the second embodiment in which by a combination of the dwell angle control circuit 450 and the constant current control circuit 430, the bias applied to the transistor 172 of the input detector circuit 410' is changed according to the engine speed, while this bias is reduced under a constant current control. The present invention is not limited to such a construction but the operation of the error preventing circuit 420' is not affected at all and a similar effect is of course expected also in the case where by eliminating the constant current control circuit 430, the bias is always applied in accordance with the engine speed thereby to enlarge the dwell angle. In the second embodiment, the capacitors 165 and 166 are charged up by a constant current, which may be replaced with equal effect by a current of exponentially variable characteristic through a resistor.

Also, the second embodiment has a construction in which the bias voltage produced from the dwell angle control circuit 450 is added to the AC output of the signal generator 300. The present invention is not limited to such a construction but may alternatively include means for properly processing the waveform of the output of a signal generator producing a rectangular wave, so that the signal thus processed is added to the bias voltage for controlling the dwell angle.

It will be understood from the foregoing description that according to an aspect of the present invention, the output of a signal generator is detected by an input detector circuit at a predetermined trigger level, a first duration of one of the polarities of the output of this input detector circuit is detected by a first circuit, and a second duration of the same polarity and longer than the first duration is detected by a second circuit. The output of the first circuit is used to start energization of the ignition coil, and the energization of the ignition coil is held regardless of the output of the input detector circuit until the generation of the output of the second circuit, thus preventing an erroneous operation which otherwise might be caused by an induction noise with the starting of energization of the ignition coil. Also, in view of the fact that the energization of the ignition coil is never started before generation of the output of the first circuit, it is also possible to prevent the erroneous operation attributable to the induction noise of the ignition voltage after cutting off the primary current of the ignition coil.

According to another aspect of the present invention, two time detector means for the first and second durations are made up of an efficient circuit in which the charge voltage waveform of a single capacitor is detected at two reference voltage levels, thus leading to the great advantage of a minimized number of parts required for integrated circuitry.

According to still another aspect of the present invention, means for changing the energization angle of the ignition coil according to the engine speed is provided by a frequency-voltage converter circuit. Differing from the general construction in which the timing of charging up of the charge capacitor for the frequency-voltage converter circuit is determined by use of a separate capacitor, the timing signal is provided by the control output of the first and second circuits according to the present invention, thus realizing An even more efficient circuit.

We claim:

1. A contactless erroneous ignition prevention type ignition system for an internal combustion engine comprising:

a signal generator for generating a signal in synchronism with the engine speed;

a waveform shaping circuit for shaping the waveform of said signal;

a time function generator circuit for generating a time indication output signal in response to an output of said waveform shaping circuit;

a first comparing circuit for comparing the output signal of said time function generator circuit with a first reference level and generating a first control signal when said indication output signal reaches said first reference level;

a second comparing circuit for comparing the output signal of said time function generator circuit with a second reference level and generating a second control signal substantially at a predetermined period after the generation of said control signal;

an ignition coil signal;

an output circuit for interrupting energization of said ignition coil; and an ignition hold circuit for preventing energization of said ignition coil until said first control signal is generated, starting the energization of said ignition coil regardless of the output signal of said signal generator until said second control signal is generated.

2. An ignition system according to claim 1, wherein said time function generator circuit includes a capacitor, and each of said first and second circuits includes a voltage comparator circuit.

3. An ignition system according to claim 1, further comprising a frequency-voltage converter circuit including a capacitor for enlarging the dwell angle in accordance with the engine speed, the charging timing for said capacitor being controlled by said first and second control signals.

* * * * *